US008533989B2

(12) United States Patent
Ziegler

(10) Patent No.: US 8,533,989 B2
(45) Date of Patent: Sep. 17, 2013

(54) SIGHTING TELESCOPE MOUNTING SYSTEM WITH CLAMPING MEANS

(76) Inventor: Gerhard Ziegler, Georgensgmünd (DE)

( * ) Notice: Subject to any disclaimer, the term of this patent is extended or adjusted under 35 U.S.C. 154(b) by 8 days.

(21) Appl. No.: 12/970,445

(22) Filed: Dec. 16, 2010

(65) Prior Publication Data

US 2011/0179690 A1 Jul. 28, 2011

(30) Foreign Application Priority Data

| | | |
|---|---|---|
| Dec. 22, 2009 | (DE) | 10 2009 060 659 |
| Dec. 22, 2009 | (DE) | 10 2009 060 660 |
| Jan. 19, 2010 | (DE) | 10 2010 005 120 |
| Jan. 22, 2010 | (DE) | 10 2010 005 590 |

(51) Int. Cl.
*F41G 1/00* (2006.01)

(52) U.S. Cl.
USPC ..... 42/124; 42/126; 42/127; 42/148

(58) Field of Classification Search
USPC ..... 42/124–128, 148
See application file for complete search history.

(56) References Cited

U.S. PATENT DOCUMENTS

| | | | | | |
|---|---|---|---|---|---|
| 1,837,290 | A | * | 12/1931 | Redfield | 42/127 |
| 2,306,972 | A | * | 12/1942 | Meisel | 42/125 |
| 2,641,057 | A | * | 6/1953 | Moore | 42/127 |
| 2,942,346 | A | * | 6/1960 | Staubach | 42/127 |
| 3,463,430 | A | * | 8/1969 | Jimenez et al. | 42/124 |
| 3,750,318 | A | * | 8/1973 | Burris | 42/127 |
| 3,785,603 | A | * | 1/1974 | Apel | 248/222.13 |
| 3,877,166 | A | * | 4/1975 | Ward | 42/127 |
| 3,880,389 | A | | 4/1975 | Burris | |
| 4,205,473 | A | * | 6/1980 | Wilson | 42/127 |
| 4,249,315 | A | * | 2/1981 | Hopson, III | 42/125 |
| 4,310,980 | A | * | 1/1982 | Pilkington | 42/127 |
| 4,353,180 | A | * | 10/1982 | Wilson | 42/127 |
| 4,934,085 | A | * | 6/1990 | Lough | 42/127 |
| 4,959,908 | A | * | 10/1990 | Weyrauch | 42/124 |
| 5,035,487 | A | * | 7/1991 | Herz | 359/896 |
| 5,070,637 | A | | 12/1991 | French | |
| 5,111,587 | A | * | 5/1992 | Plank | 42/127 |
| 5,274,941 | A | * | 1/1994 | Moore | 42/126 |
| 5,390,419 | A | * | 2/1995 | Sirkis | 42/127 |
| 5,396,725 | A | * | 3/1995 | Talbot | 42/127 |

(Continued)

FOREIGN PATENT DOCUMENTS

| | | | |
|---|---|---|---|
| DE | 15 78 319 | A1 | 11/1971 |
| DE | 7524622 | U | 2/1976 |

(Continued)

*Primary Examiner* — Michelle Clement
(74) *Attorney, Agent, or Firm* — Lucas & Mercanti, LLP

(57) ABSTRACT

A sighting telescope mounting system for a firearm. The firearm and/or the telescope, in a desired position, are aligned in an axial direction. A pivot foot is attached to the sighting telescope, and a pivot holding device is affixed to the firearm. The pivot foot and pivot holding device form a pivot joint that enables the telescope to pivot by a pivot angle around a pivot range on a plane formed by the telescope and the axial direction of the firearm. The pivot holding device has a connection surface and a clamping surface is arranged on the pivot foot and forms a contact area with the connection surface, so that the pivot foot is axially affixed. A clamping device is provided so that the connection surface and/or the clamping surface are arranged and/or designed compliantly. The pivot foot is axially held in a pre-tensioned state in the pivot holding device.

21 Claims, 15 Drawing Sheets

(56) References Cited

U.S. PATENT DOCUMENTS

| | | | | |
|---|---|---|---|---|
| 5,400,539 | A * | 3/1995 | Moore | 42/127 |
| 5,680,725 | A * | 10/1997 | Bell | 42/127 |
| 5,787,630 | A * | 8/1998 | Martel | 42/125 |
| 6,594,938 | B2 * | 7/2003 | Horton | 42/127 |
| 6,922,934 | B1 * | 8/2005 | Huan | 42/127 |
| 7,140,143 | B1 * | 11/2006 | Ivey | 42/125 |
| 7,308,772 | B1 * | 12/2007 | Millett | 42/127 |
| 7,543,405 | B1 * | 6/2009 | Ivey | 42/125 |
| 7,562,485 | B2 * | 7/2009 | Newhall et al. | 42/127 |
| 7,827,724 | B1 * | 11/2010 | Spinelli | 42/124 |
| 7,908,782 | B1 * | 3/2011 | LaRue | 42/128 |
| 7,971,384 | B2 * | 7/2011 | Lippard | 42/124 |
| 8,079,171 | B2 * | 12/2011 | Barrett | 42/125 |
| 8,136,287 | B2 * | 3/2012 | Adams | 42/124 |
| 2003/0056417 | A1 | 3/2003 | Horton | |
| 2008/0092421 | A1 * | 4/2008 | Beckmann | 42/90 |
| 2010/0263256 | A1 * | 10/2010 | Spinelli | 42/124 |
| 2011/0061286 | A1 * | 3/2011 | Wang | 42/125 |

FOREIGN PATENT DOCUMENTS

| | | | |
|---|---|---|---|
| DE | 3204152 | A1 | 8/1983 |
| DE | 3204152 | | 9/1984 |
| DE | 9406408 | | 7/1994 |
| DE | 29802854 | | 8/1998 |
| DE | 20 2006 004 542 | U1 | 6/2006 |
| DE | 10 2005 005 232 | A1 | 8/2006 |
| DE | 102005005232 | | 8/2006 |
| GB | 853 182 | A | 11/1960 |
| WO | 9315371 | A1 | 8/1993 |

* cited by examiner

SIGHTING TELESCOPE MOUNTING SYSTEM WITH CLAMPING MEANS

The present application claims priority of DE 10 2009 060 659.9, filed Dec. 22, 2009, DE 10 2009 060 660.2, filed Dec. 22, 2009, DE 10 2010 005 120.9 filed Jan. 19, 2010, and DE 10 2010 005 590.5 filed Jan. 22, 2010, and these applications are incorporated herein by reference.

BACKGROUND OF THE INVENTION

The invention relates to a sighting telescope mounting system for a firearm for mounting a sighting telescope on the firearm in a desired position, wherein the firearm and/or the sighting telescope in the desired position are aligned in an axial direction, with a pivot foot which can be attached to the sighting telescope, and with a pivot holding device which can be affixed to the firearm or vice-versa, wherein the pivot foot and pivot holding device jointly form a pivot joint, which during mounting enables the sighting telescope to be pivoted by a pivot angle around a pivot range on a plane which is formed by the sighting telescope and the axial direction of the firearm, with an connection surface which is arranged on the pivot holding device and with a clamping surface which is arranged on the pivot foot, and which when mounted forms a contact area with the connection surface, so that the pivot foot is affixed in the axial direction.

Sighting telescopes are frequently used for firearms, particularly weapons, which are designed as a telescope with a sighting mechanism which is integrated in the optics. The sighting mechanism and the firearm must be adjusted (zeroed in) in order to ensure that with the sighting mechanism, the sight is focused on a real penetration point of a projectile fired using the firearm.

In practise, however, it is sometimes necessary to separate the sighting telescope and the firearm from each other. This necessity can arise for example during transportation or storage. In order to be able to attain a reproducible mounting of the sighting telescope on the firearm after removal without renewed zeroing in, sighting telescope mounting systems are used which enable a simple separation and re-mounting of the sighting telescope on the firearm in the zeroed in position.

At least two different types of sighting telescope mounting systems are known for hunting weapons:

For example, document DE 9406408 relates to a mounting system for a "pivot rotary mounting" of a sighting telescope, wherein a front centerpin of the mounting system is inserted into a front base of a firearm and the sighting telescope is pivoted by 90°. A rear pin is inserted into a side notch during the pivot movement and is locked in place using a hand lever. A similar mounting system is also disclosed in document DE 10 2005 005232 A1.

A highly traditional type of mounting is the "Suhler claw mount" (SEM). With the Suhler claw mount, the mounting foot which is attached to the lens head of the sighting telescope is hooked into a front base plate on the firearm. After being pressed down briefly and firmly, the rear mounting foot which is affixed on the central tube of the sighting telescope latches into a rear mounting plate. In order to again remove the sighting telescope, a springed slide which is attached to the rear base plate must be drawn back as a result of which the lock on the rear foot is released and the sighting telescope can be unhooked. The Suhler claw mount is regarded as being one of the most expensive sighting telescope mounting systems since it requires highly complex fitting work. Each individual fitting surface must be reworked separately and manually in order to provide a precise seat for the sighting telescope in a desired position. Reference is made to the Suhler claw mount in document DE 29802854 U1, for example.

Document DE 3204152 C2, which appears to represent the nearest prior art, describes a modification of the Suhler claw mount, wherein functional surfaces on the front base plate are designed coaxially in relation to a central point of the pivot movement.

SUMMARY OF THE INVENTION

The object of the invention is to create a sighting telescope mounting system which provides position reproducibility of the sighting telescope and the firearm, even following multiple assembly and removal procedures.

This object is attained by means of a sighting telescope mounting system with the features described herein. Preferred or advantageous embodiments of the invention are included in the description below and the appended figures.

Within the scope of the invention, a sighting telescope mounting system for a firearm, in particular for a hunting and/or sporting weapon, is recommended which is designed for mounting a sighting telescope on the firearm. The sighting telescope can be designed as an optical telescope, although a design as any other mapping device required is also possible.

The sighting telescope mounting system is created in such a manner that the telescope can be mounted in a desired position, wherein the desired position describes the position in which the sighting telescope captures at a certain distance a penetration point of a projectile shot from the firearm. In particular, the desired position is to be regarded as that position which according to specialists is determined by zeroing in. For the purpose of the description, the alignment of the firearm and/or the sighting telescope will be referred to below as the axial direction; in the description, a radial direction is relative to said axial direction.

The sighting telescope mounting system preferably builds on the claw mount or counter-claw mount, wherein a front or a rear foot of the sighting telescope mounting system—referred to below as the pivot foot—can be hooked into a pivot holding device which can be affixed and/or is affixed to the firearm. A vice-versa design is also feasible within the scope of the invention, wherein the pivot foot can be attached to the firearm and the pivot holding device can be attached to the sighting telescope. The pivot foot and the pivot holding device together form a pivot joint when hooked in, wherein during mounting, the sighting telescope is pivoted in numerical terms by a pivot angle and in terms of its position by a pivot area. A further foot—also known as the arresting foot—is affixed on a further holding device on the firearm.

The pivot plane is defined by the alignment of the sighting telescope and the alignment of the firearm, wherein in a projection direction, the firearm and the sighting telescope are always congruent during mounting. Thus far, the sighting telescope mounting system is similar to the known Suhler claw mount.

If the pivot holding device is inspected somewhat more closely, it shows a connection surface which is roughly aligned in the radial direction, but which in particular can also be curved and/or angled etc. The pivot foot comprises a clamping surface which is similarly aligned, and which when mounted forms a contact area with the connection surface, so that the pivot foot is affixed, and in particular, clamped in the axial direction. In particular, the contact area prevents the sighting telescope mounting system from being displaced in the direction of the arresting foot. The contact area thus forms a form-fit and/or a fixed bearing for the sighting telescope mounting system in the axial direction as well as the direction of travel, preferably in the direction of the arresting foot.

The contact area can be designed for example as a line contact or as a contact point. Naturally, these are idealised assumptions; due to the Hertzian stress, these basic geometric forms are usually broadened or converted into compressed ellipses. It is also feasible that the pivot foot is attachable and/or attached to the firearm and the pivot holding device is attachable and/or attached to the sighting telescope.

Within the scope of the invention, a clamping means is recommended, wherein the clamping means are designed in such a manner that the connection surface and/or the clamping surface is or are arranged and/or designed compliably, so that the pivot foot is held in the pivot holding device at least in the axial direction and in particular is elastically pre-tensioned. Thus, the contact area does not form a non-compliant, rigid arrest, but it is provided that the connection surface and/or the clamping surface is capable of reacting to a high load, in particular in an elastic and compliant manner. As an option, an additional pre-tensioning can also be conducted in the radial direction.

The invention is here based on the consideration that at first sight, a mechanical, rigid retention of the pivot foot in the pivot holding device is designed to achieve the greatest possible reproducibility, even following multiple assembly and removal procedures. However, the insertion of the pivot foot in the pivot holding device and additionally, the dynamic load during the actual shooting procedure means that the material settles in the contact area, so that in this position, sooner or later—in particular following multiple removal procedures—undesired tolerances arise. In this state, it has until now been necessary to send the sighting telescope mounting system for an overhaul. By contrast, the invention recommends the clamping means, which are preferably designed in such a manner that both the loads during assembly and removal procedures and during the actual shooting procedure are elastically retained and that thus, the sighting telescope mounting system is protected against the settling processes of the material described above.

In their most general definition, the clamping means are designed with any structure required, and can preferably be designed as a separate elastic element, an integrated elastic element, elastic areas, a material elasticity, and/or as a form elasticity.

With a preferred embodiment of the invention, in the desired position, the connection surface and/or the clamping surface, in particular in the contact area, is deflected in the axial direction by a pre-tensioning path of at least 5 μm, preferably of at least 10 μm or 20 μm, in particular of at least 60 μm. Alternatively or as a supplement, the pivot foot is pre-tensioned in the pivot holding device over the named length. Alternatively or as a supplement, in the desired position, the connection surface and/or the clamping surface, in particular in the contact area, is deflected in the axial direction by a pre-tensioning path between 5 μm, preferably 10 μm and in particular, 20 μm and 60 μm. If for example one observes a longitudinal section along the axial direction, at least one of the two surfaces is displaced by the named length in an elastic and/or spring-loaded manner.

Without the clamping means, a single, similar displacement of the connection surface and/or the clamping surface in the sense of a plastic deformation is possible, but this would lead to a "gobbling" or hooking of the pivot foot in the pivot holding device, so that mounting or dismantling would not be possible without causing destruction.

One possible method of measuring the pre-tensioning path in the desired position would for example be to compare the technical drawings in the longitudinal cross-section, in the deflected state on the one hand, and on the other, with overlapping clamping and connection surfaces resulting from component sizes.

With an advantageous further embodiment of the invention, the clamping means is not limited to the pre-tensioning path, but the pre-tensioning path uses only a part of the entire total pre-tensioning path possible in the axial direction, which is at least 20 μm, preferably at least 30 μm and in particular at least 80 μm. Due to the selection of a larger total pre-tensioning path compared to the used pre-tensioning path, it is ensured that the sighting telescope mounting system operates continuously in the elastic deformation area, and avoids the plastic deformation area which would lead to damage to the sighting telescope mounting system.

In terms of the structure, it is possible to arrange the clamping means in the pivot foot and/or in the pivot holding device. In the first case, the length of the pivot foot is decreased in the axial direction when the total pre-tensioning path is used. With the second option, it is provided that the connection surface deviates in the axial direction and in so doing, increases the pivot holding device.

With a further alternative of the invention, the clamping means is formed by an interaction between the pivot foot and the pivot holding device. During deflection, the pivot foot and pivot holding device are moved relative to each other, wherein an elastic area which forms a part of the clamping means can be arranged either in the pivot foot and/or in the pivot holding device. Due to this modification, it is possible that the elasticity is not formed only by the elasticity in the axial direction of the pivot foot or pivot holding device, but also through elasticity in a deviating direction, in particular in a radial direction or in a direction which is vertical to the axial direction.

In one possible structural design, the pivot foot comprises a holding bracket which grips a section of the pivot holding device. The section of the pivot holding device is preferably arranged in a stationary and/or rigid manner in the pivot holding device. The holding bracket is attached to the section of the pivot holding device in such a manner that an elastic counterforce is built up when a load is applied in the axial direction. In particular, the edge areas of the holding bracket are pressed apart and thus form the elastic device. The holding bracket is designed to be elastic and/or compliant e.g. with regard to the opening angle of the two bracket ends, so that the clamping means are formed by the holding bracket. This has the advantage that the clamping means are arranged on the sighting telescope, and thus when the elastic properties decrease, they can be replaced more easily. The elasticity can for example be achieved by an extended recess, which is inserted into an area between the bracket ends, and which has larger dimensions than would be necessary for the pivot for reasons relating to the interfering contour. Alternatively, it is also possible to integrate the holding bracket in the pivot holding device.

With one possible structural realisation, the gripped section of the pivot holding device is designed as a pin, in particular a steel pin, which can be ground as an option. With one alternative, the gripped section is arranged as a single piece and/or in a single material in the pivot holding device.

In particular with the latter embodiment, the pivot foot is installed in the pivot holding device along the length given in the introduction, and is displaced in the axial direction.

As a further possible supplement, it is recommended that in the desired position, the contact area is arranged in a radial alignment and/or at a distance from an edge of the connection surface in the direction facing the sighting telescope. The connection surface thus extends further in the radial alignment than the contact area, so that the contact area is positioned in an inner area of the connection surface.

This structural supplement establishes the basis for two possible technical improvements:

On the one hand, the load on the edge area of the connection surface is decreased. Due to the decrease in the load on the edge area, it is possible to significantly increase the number of assembly and removal procedures without subsequently correcting the sighting telescope mounting system. While with the Suhler claw mount, only 10 to 20 changes were usually possible, experiments have shown that with the present sighting telescope mounting system, more than 100, even over 200 changes can be conducted without subsequently correcting the contact area. The maintenance intervals for the sighting telescope mounting system are thus drastically increased compared to the original Suhler claw mount.

A second technological effect is that when a small change is made to the pivot angle, for example when folded out from the desired position by up to +/−1° or by up to +3°, the contact area remains at a distance from the edge of the connection surface, so that a tolerance is provided with regard to the pivot angle. The pivot angle is affixed at the desired position using the other foot, wherein however an overdefinition of the pivot angle—as has frequently been standard practise with the Suhler claw mount—is no longer given.

In terms of the structure, the distance can be recognised e.g. by the fact that in the desired position between the connection surface and the clamping surface, starting from the contact area, a gap or comma gap or a gap with unparallel walls is provided which opens outwards in the radial direction. In a longitudinal section through or parallel to the axial extension, the gap width increases in the radial direction in a monotone manner or even in a severely monotone manner. In particular, the gap width changes continuously.

In order to generate the gap, it can be provided that in the named longitudinal section, the connection surface and/or the clamping surface is curved. Different options are possible here: On the one hand, the connection surface can be curved and the clamping surface can be convex, or vice-versa. Instead of a straight extension, a surface can also have a further convex curve, so that two convex surfaces abut each other. Even a concave curve with a convex curve can be used, which are selected in such a way however that the gap which opens is formed outwards in the radial direction. The type of curve can correspond to a pitch circle, a parabola or any free form required.

With a further development of the invention, it is provided that the pivot force is constant or almost constant in a pivot angle range which is e.g. less than 5° around the desired position, in particular solely in the swing open direction. The required pivot torque is preferably greater than 1 Nm, in particular greater than 5 Nm and in particular, greater than 10 Nm. The required pivot torque is preferably less than 30 Nm and in particular, less than 20 Nm. With this further development, it is again emphasised that the affixation of the pivot foot in the axial direction is independent or almost independent of small changes to the pivot angle from the desired position, or if appropriate, from small changes to the position of the contact area on the connection surface. It is particularly preferred when the sighting telescope is tensioned in a self-retaining manner by the mounting system in several positions in the pivot angle range around the desired position. With one preferred embodiment, the pivot foot is arranged in the pivot holding device in an impact-free manner with regard to the pivot angle.

The pre-tensioning force in the desired position in the axial direction is preferably greater than 100 N, in particular greater than 2000 N, in a preferred form 4000 N and should preferably be limited to less than 8000 N. The pre-tensioning force acts in particular between the connection surface and the clamping surface.

The following options are available, among others, when selecting the pivot area:

On the one hand, a support point or support area of the pivot foot can form the pivot area on the pivot holding device. The support point or area can be arranged on an outer side which faces away from the sighting telescope, or on an inner side of the pivot holding device which faces away from it. It is also feasible for the support point or support area to be arranged on a base of the pivot holding device.

With a structural realisation of the invention, it is provided that the pivot holding device is designed as a mounting plate, which can preferably be inserted into a dovetail guide in the firearm.

It is also preferred that the pivot foot comprises a hook section which enables a claw mount into the pivot holding device. This feature in particular again shows the similarity with the famous Suhler claw mount.

With a further development of the invention, the pivot foot comprises at least one or more, and preferably precisely two, hook sections, which are preferably arranged at a distance from each other. In this design, the pivot foot according to the invention is highly similar to the classic pivot foot. The use of two hook sections supports a tilt-free mounting of the sighting telescope mounting system. It should be noted that the hook section(s) form part of the pivot joint, and thus have a dual function. Preferably, the hook sections are opened to the side which faces away from the arresting foot.

With one possible supplement to the invention, the sighting telescope mounting system comprises the arresting foot and an arresting holding device, which together form an arrest, wherein the arrest is designed as a fixed bearing in the transverse direction, and as a loose bearing in the axial direction.

It is particularly preferred that the arresting holding device be designed as a mounting plate, which is affixed in a form-fit manner on the firearm, in particular firmly bolted, and as an optional addition is firmly bonded, for example by soldering.

The arresting foot comprises at least one support area, wherein the support area can be divided into different individual sections, while by contrast, the arresting holding device has at least one support area which can also be distributed over several individual areas. In the desired position in an arresting contact area, the support area and the connection area create a form-fit support for the arresting foot on the arresting holding device in a first radial direction. In particular, the arresting contact area forms an end stop when the sighting telescope is swung back in around the other mechanical interface on the firearm.

As a further function, the arresting foot and the arresting holding device form an arrest which detachably affixes the arresting foot in the other radial direction, i.e. in the swing open direction, in the desired position. Preferably, further components are used in the arresting foot—arresting holding device assembly, such as a latch or a slide.

With a further development of the invention, it is recommended that the support surface and the connection surface are designed in such a manner that the arresting foot can be arrested in the arresting holding device in different angle positions around at least one pivot axis relative to the arresting holding device. As a result, the arresting foot is retained securely and/or in a reproducible position in the arresting holding device when the arresting foot is turned around at least one pivot axis opposite the arresting holding device. Preferably, the angle positions extend in an overall range of at least 0.01°, preferably at least 0.1° and in particular at least 0.4°.

Here, one consideration of the further development is that the affixation of the sighting telescope on the firearm can be distributed over the two mechanical interfaces, wherein when position deviations of the two mechanical interfaces from an ideal position occur, the arrest can be mounted without adjustment work, as has been the case to date. The arresting foot is thus angle tolerant, and can thus also be used without subsequent correction when the pivot foot and the arresting foot are not arranged in alignment or twisted towards each other.

A first possible pivot axis is formed by a yaw axis, so that the arresting foot can be arrested around a radially aligned pivot axis relative to the pivot holding device. This angle tolerance can become important with a non-aligned arrangement in the direction of travel or the axial direction of the interfaces.

A second possible pivot axis is formed by a roll angle axis, so that the arresting foot can be arrested in a twisted manner around a pivot axis which is aligned in the direction of travel relative to the pivot holding device. This angle tolerance can become important when the interfaces are twisted towards each other. This option is not absolutely necessary with some sighting telescopes, since they have a transverse adjustment (Q) and/or a rotation setting option for the sighting telescope around its own axis. The angle tolerance around the roll angle axis can thus also be achieved by transverse positioning and/or the rotation setting option. By contrast, telescopes are also known which do not have these setting options, such as sighting telescopes with a firmly attached track system as an interface to the sighting telescope mounting system. With these embodiments, the angle tolerance with regard to the roll angle is particularly advantageous.

A third possible pivot axis is formed by a pitch angle axis, so that the arresting foot is arrested in a twisted manner relative to the arresting holding device around a pivot axis which is preferably aligned vertically to the axial extension and to the radial extension. This angle tolerance can become important when the interfaces are pitched towards each other.

Within the scope of the further development, the at least one pivot axis can comprise any one, or any two, or all three of the options described. It is also within the scope of the invention that an at least one-dimensional, preferably two-dimensional and in particular, three-dimensional pivot of the arresting foot is included in another mathematical system which is analogue or equivalent. For example, the arrest could be formed by a ball socket-type joint and/or a rocker-type holding device.

In another version, the arrest is preferably designed in such a manner that the pivot of the arresting foot around one of the pivot axes which runs through the arresting holding device, in particular through the support area and/or connection area and/or arresting contact area, is tolerated relative to the arresting holding device.

In other words, the arresting foot has a degree of play with regard to the rotation or pivot described relative to the arresting holding device.

As an alternative or a supplement it is ensured that correct mounting is also possible even when the arresting foot and arresting holding device are pivoted or twisted towards each other around a or the radially aligned axis or another of the possible pivot axes. This angle-tolerant retention of the arresting foot in the arresting holding device enables a deviation from a parallel alignment of the arresting foot and the arresting holding device with some embodiments by more than 0.01°, preferably by more than 0.1°, and in particular by more than 0.4°, and specifically by up to 3° or more.

This advantageous further development is based on the consideration that the two mechanical interfaces usually do not exactly align in the desired position in the axial direction, but can be displaced in relation to each other e.g. in the transverse direction. Due to the angle-tolerant retention of the arresting foot in the arresting holding device, the installation and initial adjustment, i.e. the zeroing in, of the sighting telescope mounting system is made significantly easier, since the transverse displacement described or another displacement has no effect, or only a negligible effect, on the arrest.

With one advantageous further development of the invention, the arresting foot is movable in the axial direction and held in a form-fit manner in the transverse direction. The movement in the axial direction is preferably possible by at least 0.1 mm, in particular by at least 1 mm, and specifically, by at least 2 mm.

Within the scope of the further development, the axial positioning of the firearm is defined by the other mechanical interface, so that during arresting, the arresting foot does not have to be defined in the axial direction, and thus forms a loose bearing in this direction and/or has a degree of play in the axial direction. By contrast, however, it is ensured that the arresting foot is held in a defined manner in the transverse direction, and preferably also upwards, i.e. in the radial direction. With the further development, a low-voltage mounting of the sighting telescope on the firearm is made possible due to the fact that an overdefinition of the mounting system in the axial direction is avoided.

With one preferred structural realisation of the invention, the arresting contact area is formed by a plurality of point and/or line contacts, which implement the form-fit hold in the transverse direction. Preferably, at least or precisely two point or line contacts are used. In order to achieve the angle tolerance of the arrest, it is preferred that the line contacts be rectified with the radial axis. Due to the rectification of the radial axis and the line contacts, it is possible to displace the line contacts during a pivot around the radial axis without obtaining a form-fit block in the pivot direction. In one embodiment which is close to reality, a preferred precise parallel alignment of the line contacts and the radial axis will not be able to be realised multiply, so that the same alignment also implements this invention concept.

With one possible structural design of the invention, the connection area and/or the support area are designed in one profile vertically to the axial direction of the firearm and/or the sighting telescope in such a manner that they form one or more funnel sections. The funnel sections are aligned in such a manner that they implement a centring or self-centring of the arresting foot in the arresting holding device. Should, in functional terms, the connection area be designed as a female connector and the support area as a male connector, it is preferred that the funnel section(s) taper in the direction leading away from the sighting telescope to the firearm. In the reverse case with regard to the female and male connector, the funnel direction should also be reversed, so that the centring effect and the mechanical compatibility is ensured.

With one structural realisation of the invention, the walls of the funnel section or the funnel section are designed to run in a straight or curved manner in the profile of the connection area and/or support area. A plurality of combination options are available for this purpose:

When the touching walls of the funnel section of the connection and support area both run in a straight manner and are arranged in parallel to each other, a line contact is formed. The same applies when in the arresting contact area both touching walls are formed with the same curvature radius and are curved in the same direction. With other embodiments, one of the walls is straight and the other wall is curved, in particular designed in a convex manner, so that a point contact results. The role of the convex wall can include both the connection area and the support area. It is also possible that the touching walls be curved in the same direction with different curvature radii, e.g. in terms of an osculation, so that a point contact is also formed. As a further alternative, the touching walls can be curved in a convex-convex manner, which also results in a point contact.

In a longitudinal section through the arresting contact area parallel to the axial direction, namely through the arresting contact area, the connection area is preferably aligned in such a manner that it runs straight, in particular in parallel to the axial direction. This straight progression forms the basis for the axial degree of play of the arresting foot in the arresting holding device, wherein the arresting foot is movable on the connection area in the axial direction.

In the same longitudinal section through the arresting contact area parallel to the axial direction, the support area shows two support flanks which are curved in the same direction, and which are both curved outwards in a convex manner. The curvature of the support flanks can be sections of a shared circle or sections of a circle arc digon lens, i.e. an intersection-type form which is generated when two circles partially overlap and together form a section area. This can however also be sections of an oval, a ship form or a lemon form. It is also possible that not only sections of the named forms, but also the complete forms, can be created by the support flanks. In a particularly preferred manner, the two support flanks are formed in a mirror-symmetrical manner to a symmetry axis parallel to the axial direction.

In particular when—as will be shown below—the arresting foot has more than one hook section with support areas, the support areas can take on similar forms to those described above, but are preferably designed as free-form surfaces. Specifically, the support areas of a hook section are designed to be asymmetrical to each other to a symmetry axis parallel to the axial direction.

Due to the combination of a connection and a straight progression in the longitudinal section and a support area which has curved support flanks, the support area and the connection area can be pivoted towards each other around the aforementioned radial axis or more generally around the yaw axis, roll axis and/or pitch axis by a low degree angle, e.g. in a range between 0.01 and 3 degrees, wherein the contact areas move along the support areas or connection areas, while at the same time still implementing the form-fit function.

It is also feasible that the structural design of the connection area and the support area can be interchanged, so that the support area runs straight and the connection area accordingly has a curved design. It is also possible for both the connection area and the support area to have a curved design in the longitudinal section.

As an alternative or a supplement to this, the support area forms a mushroom head, a tapered head or a shuttle, or sections of these. In particular when the arresting foot on the arresting holding device is held only by a funnel section or two walls of the funnel section, it is preferred that the support area be designed as a rotation symmetrical area, wherein the radial axis of the pivot is then guided through the symmetry axis.

In particular when—as is preferred—an arresting holding device is provided with two funnel sections or an arresting foot which also has two funnel sections which correspond to it, it is preferred that the form of the support area be extended in a longitudinal form towards the axial direction.

The arresting foot can comprise precisely one hook section. With one possible further development of the invention, the arresting foot comprises at least two, or precisely two, hook sections, wherein the support area is arranged on at least one hook section. Preferably, the support area is arranged on both hook sections, or distributed over both hook sections, wherein the hook sections in the support section can respectively comprise the form described above. It is particularly preferred that the arresting holding device comprise a holding device for the arresting foot with at least two, or precisely two, slits.

In order to implement the arrest in the other radial direction, it is preferred that the arresting holding device comprise a locking slide which can be inserted into holding areas of the hook sections on a longitudinal section plane. Due to the insertion of the locking slide into the holding areas, a form-fit fixation of the arresting foot in the opening direction of the arrest is achieved.

Further features, advantages and effects of the invention will be included in the description of a preferred exemplary embodiment of the invention below.

DETAILED DESCRIPTION OF THE INVENTION

Figure 1A:
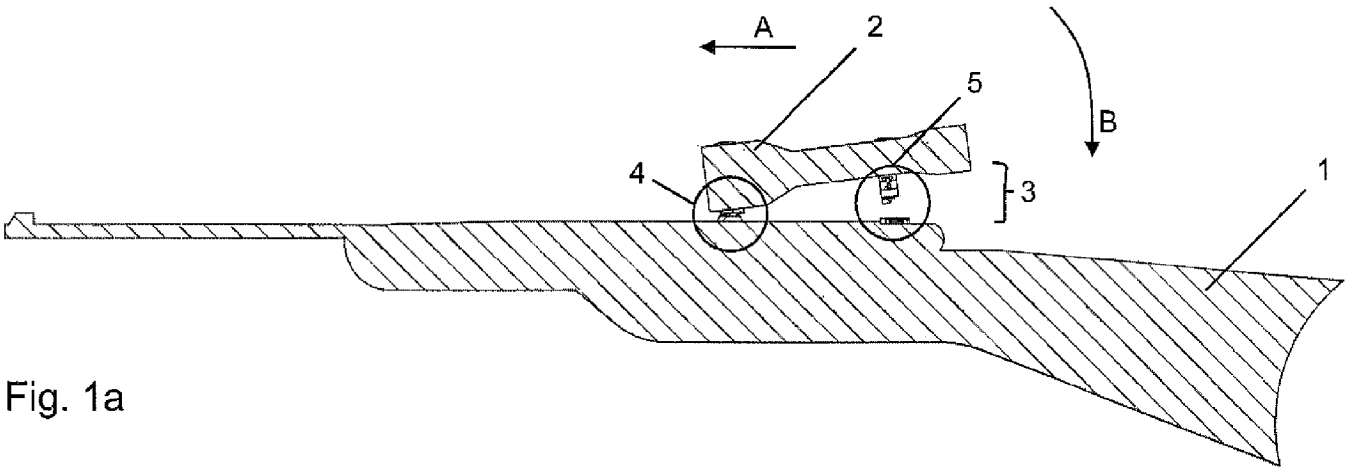
FIGS. 1*a, b* show a side view of a sighting telescope mount on a firearm as an exemplary embodiment of the invention

The same parts, or parts which correspond to each other, are respectively assigned corresponding or the same reference numerals.

Figure 1B:
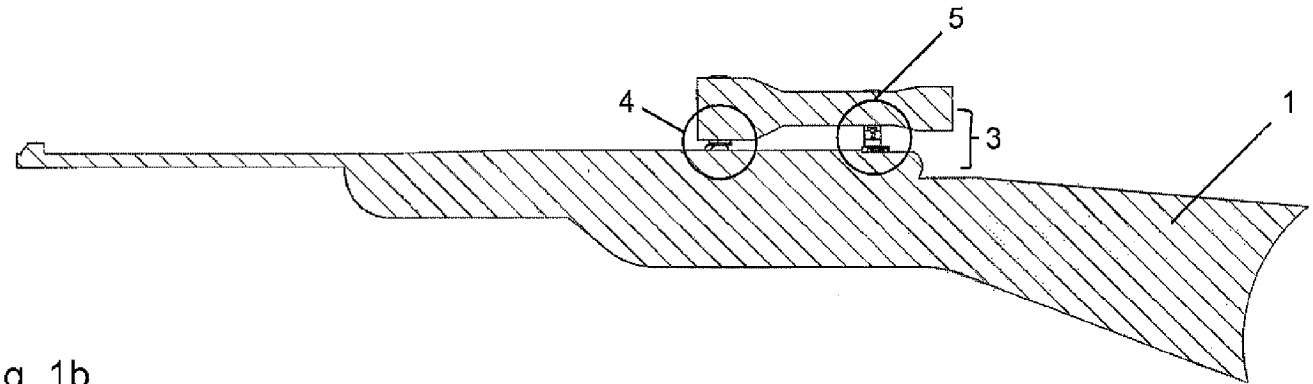

FIGS. 1*a* and 1*b* show in a schematic cross-section view a firearm 1 which is designed as a hunting weapon, to which a sighting telescope 2 is mounted. In order to couple the sighting telescope 2 to the firearm 1, a sighting telescope mounting system 3 is provided which comprises a front attachment area 4 and a rear attachment area 5. During the mounting procedure, the sighting telescope 2 is first hooked in the direction of the arrow A in the front attachment area 4, and then pivoted by a pivot angle using a pivot movement around the front attachment area 4 according to arrow B, so that the rear attachment area 5 is arrested. The pivot is here conducted on the sheet plane in FIGS. 1*a, b*, on which both the axial extension of the firearm 1 and the axial extension of the sighting telescope 2 lies.

Figure 2A:
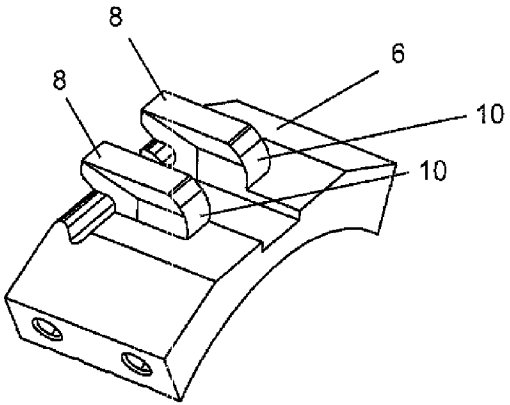
FIG. 2*a* shows the pivot foot of the sighting telescope mounting system in FIGS. 1*a, b*

In FIGS. 2*a, b* and 3, individual parts of the front attachment area 4 are shown respectively in a schematic three-dimensional view.

Figure 2B:
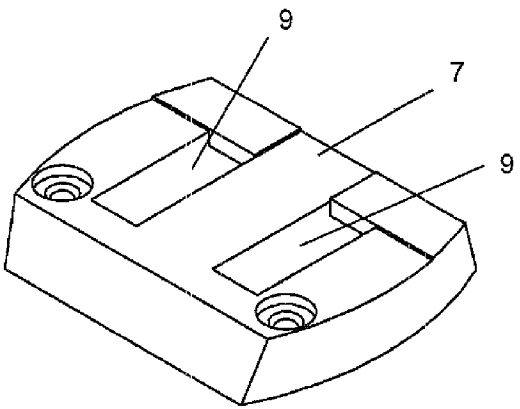
FIG. 2*b* shows the pivot holding device on the firearm of the sighting telescope mounting system shown in FIGS. 1*a, b*

FIG. 2*a* shows a pivot foot 6 which is affixed to the sighting telescope 2; FIG. 2*b* shows a pivot holding device 7 in the form of a mounting plate which is affixed on the firearm 1 by a dovetail guide and/or using screws. The pivot foot 6 is designed as a ring segment and comprises two hooks 8 which are arranged at a distance from each other and which can be inserted into corresponding slits 9 of the pivot holding device 7. During the mounting procedure, the hooks 8 are inserted and hooked in, and thus form a pivot joint together with the pivot holding device 7, which permits the sighting telescope 2 to be pivoted in the direction of the arrow B. The hooks 8 are oriented away from the rear attachment area 5 during mounting. On the side facing towards the rear attachment area 5, the hooks 8 respectively bear a clamping surface 10 which enables an affixing and clamping of the pivot foot 6, and thus of the sighting telescope 2 in the axial direction. The function of the clamping surface 10 will be explained below. The side surfaces of the hooks 8 which are oriented in the direction of revolution around the sighting telescope 2 are retained superficially and with a precise fit, so that a total of four, or at least two, guide surfaces are formed by the side surfaces. The position of the pivot foot 6 is affixed in the transverse direction to the axial direction via the side surfaces.

Figure 3:
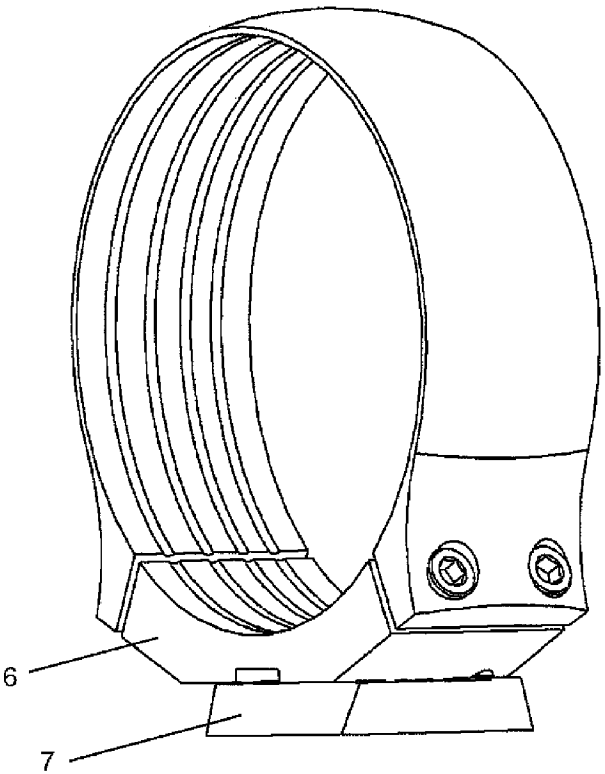
FIG. 3 shows the front holding device of the mounting system in FIGS. 1*a, b*

FIG. 3 shows in a schematic three-dimensional view the front attachment area 4 of the sighting telescope mounting system 3 with a firearm 1 and sighting telescope 2 which are not shown in the drawing. The pivot foot 6 is here hooked into the pivot holding device 7 and brought into the desired position. In order to hold the sighting telescope 2, a metal grip is bolted on in the direction of revolution, which together with the pivot foot 6 forms a mechanical holding device for the sighting telescope 2. With other embodiments, the sighting telescope 2 can also comprise a track which is aligned in the direction of travel, wherein the pivot foot 6 is affixed to the track.

In FIGS. 4, 5, 6, 7 and 8, different embodiments of the invention are shown respectively in a longitudinal section through one of the hooks 8. The views show both variations of the hooking-in mechanism and of the clamping surface 10, wherein further exemplary embodiments are disclosed by any combination required of these variations.

Figure 4:
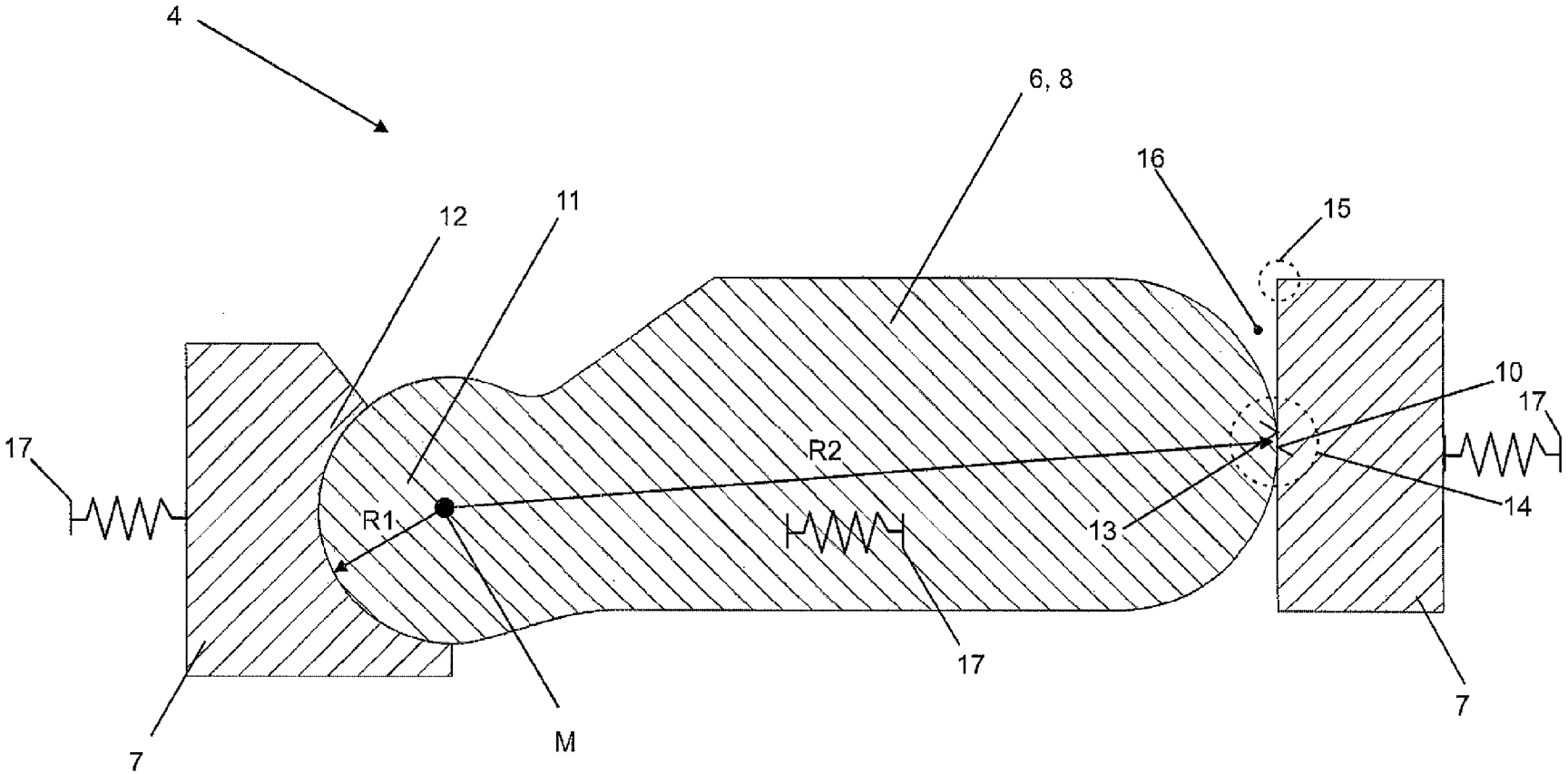
FIG. 4 shows a schematic longitudinal view in the area of the pivot foot of the sighting telescope mounting system as a first possible embodiment of the invention

FIG. 4 shows a hook 8 which for the purpose of hooking in comprises in the longitudinal section shown a hook head 11 with a circle segment form and a radius R1 as a hook 8, which grips into a bearing position 12 of the pivot holding device 7 which is designed correspondingly to it, and is there supported in such a manner that it can be pivoted around the central point M of the hook head 11, so that the sighting telescope 2 can conduct the pivot according to the arrow B shown in FIG. 1. The bearing position 12 can also be formed by just two support areas, instead of the complementary, concave form shown here. The clamping surface 10 of the hook 8 is in contact with a radially aligned connection surface 13 in a contact area 14.

FIG. 4 shows the desired position of the pivot foot 6 and thus of the sighting telescope 2. In this desired position, the contact area 14 is at a distance from an edge area 15 of the connection surface 13. As an example, the distance is greater than 0.5 mm, preferably greater than 1 mm and specifically greater than 1.5 mm. With one variation of the pivot angle around the desired position, the contact area 14 remains continuously at a distance from the edge area 15. In particular, a gap 36 extends in the radial direction, which is formed by the clamping surface 10 and the connection surface 13, and which opens steadily starting from the contact area 14.

Due to the remaining area of the connection surface 13 between the contact area 14 and the edge area 15, an abrasion of the edge area 15 is avoided, so that with the mounting system 3 frequent assembly and removal of the sighting telescope 2 is possible without overhauling the mounting system 3. If in the exemplary embodiment shown, the radius R2 of the clamping surface 10 is selected in such a manner that it corresponds to the distance between the contact area 14 and the centerof rotation M, and additionally, the same radius is used for the curvature, the contact area 14 does not move at all with slight variations of the pivot angle, e.g. of less than 1° or less than 0.5°.

Similar effects can also be attained, however, when the clamping surface 10 is designed to be level, and by contrast, the connection surface 13 is curved. Both surfaces can also be curved, wherein on the one hand, a curvature in opposite directions and on the other, a curvature in the same direction with different degrees of curvature is possible. All these exemplary embodiments can be designed in such a manner that the contact area 14 is at a safe distance from the edge area 15 when in the desired position, and that it has a certain angle tolerance with regard to the pivot angle.

In order to achieve a pre-tensioning in the axial direction or a clamp in the axial direction, clamping means 17 can be provided which on the one hand press the connection surface 13 in the direction of the hook 8, and on the other hand press the bearing position 12 in the direction of the hook 8 and/or which are arranged in the hook 8 and rest in the axial direction against the bearing position 12 and the connection surface 13.

The clamping means 17 are dimensioned in such a manner that in the desired position shown, a pre-tensioning path of at least 10 μm results. In a relaxed state, the connection surface 13 and the clamping surface 10 overlap in the area of the contact area 14 around the pre-tensioning path. The clamping means 17 can here be designed in such a manner that they can provide a larger overall pre-tensioning path of e.g. greater than 50 μm. In particular, both the pre-tensioning path and the overall pre-tensioning path are in an elastic area of the clamping means 17.

Figure 5:
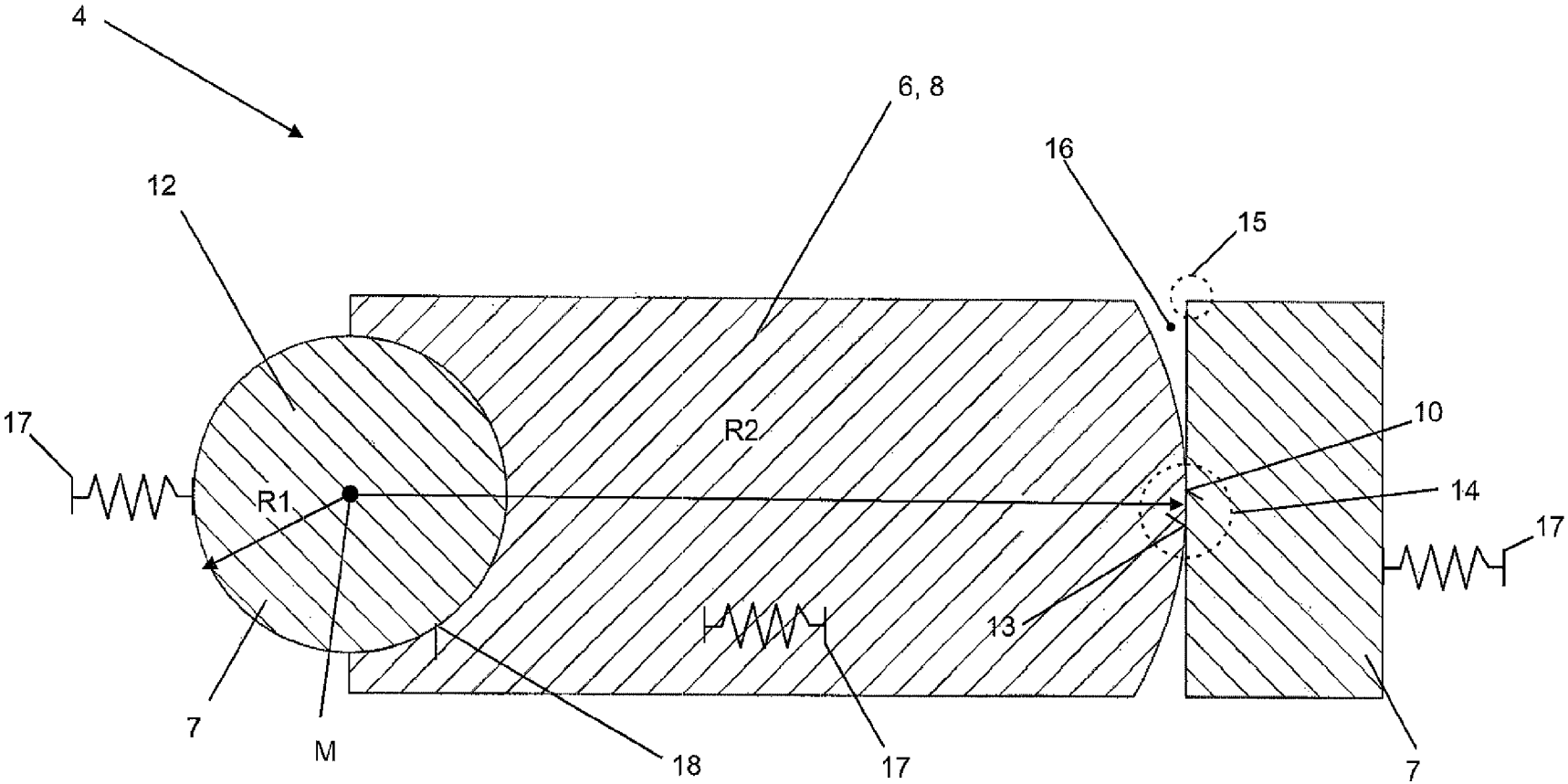
FIG. 5 shows in a similar view as FIG. 4 a second embodiment of the invention

FIG. 5 shows a second exemplary embodiment of the invention which essentially differs from the exemplary embodiment shown in FIG. 4 due to the fact that the bearing position 12 is designed as a pin, which can for example be hardened and ground, and which is designed as part of the pivot holding device 7. In this case, the hook 8 comprises a pin holding device 18, so that the hook 8 can pivot around the central point M which is now located in the centerof the pin. Here, the individual areas can also be equipped with clamping means 17. The pin holding device 18 can in the cross-section view shown also be designed as a V-shaped holding device. It can also be sufficient for components to be restricted to the functional surfaces, so that instead of a pin, a cylindrical section or even only several cylinder barrel surface sections are used as a bearing position.

Figure 6:
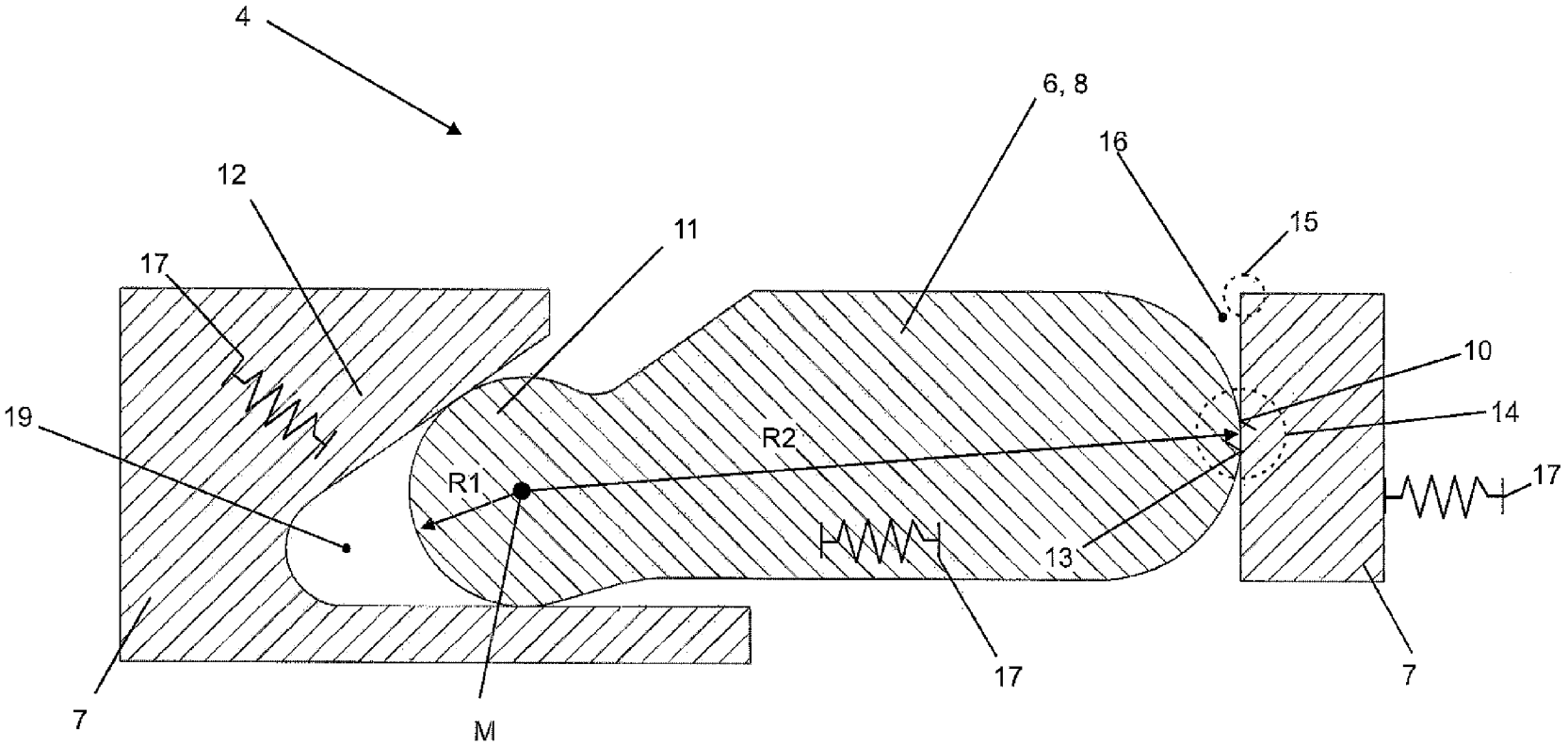
FIG. 6 shows in the same view as FIGS. 4 and 5 a third embodiment of the invention

FIG. 6 shows a third exemplary embodiment of the invention, wherein the hook 8 is designed in a similar manner to the embodiment shown in FIG. 4, so that a reference is made to the description there. The pivot holding device 7 is however realised in a different manner. Here, a jaw 19 is formed to hold the hook head 11, which guides the hook head 11 during the pivot movement. The jaw 19 can as a holding bracket be designed to be elastic within certain limits, so that when subjected to a load in the axial direction, it can expand through the hook head 11, thus forming the clamping means 17. As an alternative or a supplement to this, further clamping means can again be provided.

Figure 7:
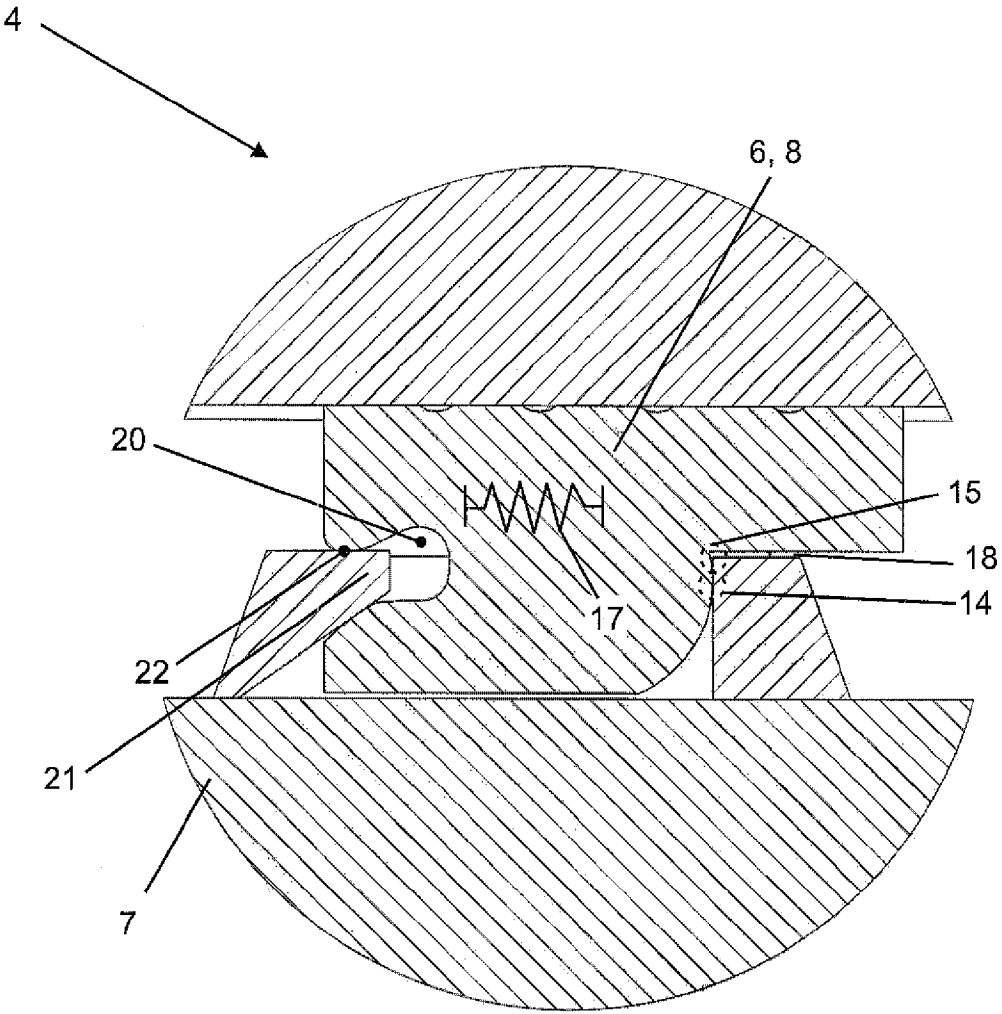
FIG. 7 shows in the same view as the preceding figures a fourth embodiment of the invention

FIG. 7 shows a next embodiment of the invention, wherein the hook 8 comprises a hook jaw 20 which grips a stationary area 21 of the pivot holding device 7. The hook jaw 20 lies with a support area 22 on an upper side of the stationary area 21, wherein the support area 22 at the same time forms a pivot point or a pivot area for the pivot movement of the pivot foot 6 or the sighting telescope 3. Here also, the hook jaw 20 and the stationary area 21 are designed in such a manner that clamping means 17 are formed, which implements a pre-tensioning of the hook 8 in at least the axial direction against the connection surface 13. As an option, the hook jaw 20 can be designed in such a manner that further pre-tensioning portions of the hook pre-tension at an angle 8. In particular, the hook jaw 20 holds the area 21 in a pre-tensioned and/or play-free manner.

In the exemplary embodiment shown, the contact area 14 has slipped closer to the edge area 15 in the desired position; however, the gap 16 remains, so that the sensitive edge area 15 is not subjected to stress and cannot be abraded. In the detailed view, this area is thus designed in the same manner as is shown in the preceding figures. It should also be noted that between the pivot foot 6 and the pivot holding device 7, in an area adjacent to the edge area 15, a gap 18 which runs in the transverse direction is formed, so that from the desired position, the pivot foot 6 can be moved in a swing-open direction as well as in a closing direction without a mechanical end stop. The pre-tensioning force in the axial direction is at least 100 N, preferably at least 2000 N. The pre-tensioning force is preferably less than 8000 N. With this pre-tensioning force, the pivot foot 6 presses against the clamping surface 10.

All the exemplary embodiments shown share the feature that even with a moderate variation of the pivot angle of e.g. less than 1°, in particular less than 0.5°, the contact area 14 remains at a distance from the edge area 15, so that different positions can also be set alongside the desired position with low-level abrasion or no abrasion at all. Due to the clamping means 17, the force required for the pivot is almost constant in the named pivot angle range. Furthermore, the pivot foot 6 is arranged as a clamp in such a manner that the sighting telescope 2 is self-retaining in the pivot angle ranges. In particular, the pre-tensioning force is also constant, or near-constant, between the clamping surface 10 and the connection surface 13 within the above-named pivot angle range, i.e. with a maximum deviation of 20% of the pre-tensioning force in the desired position.

Figure 8:
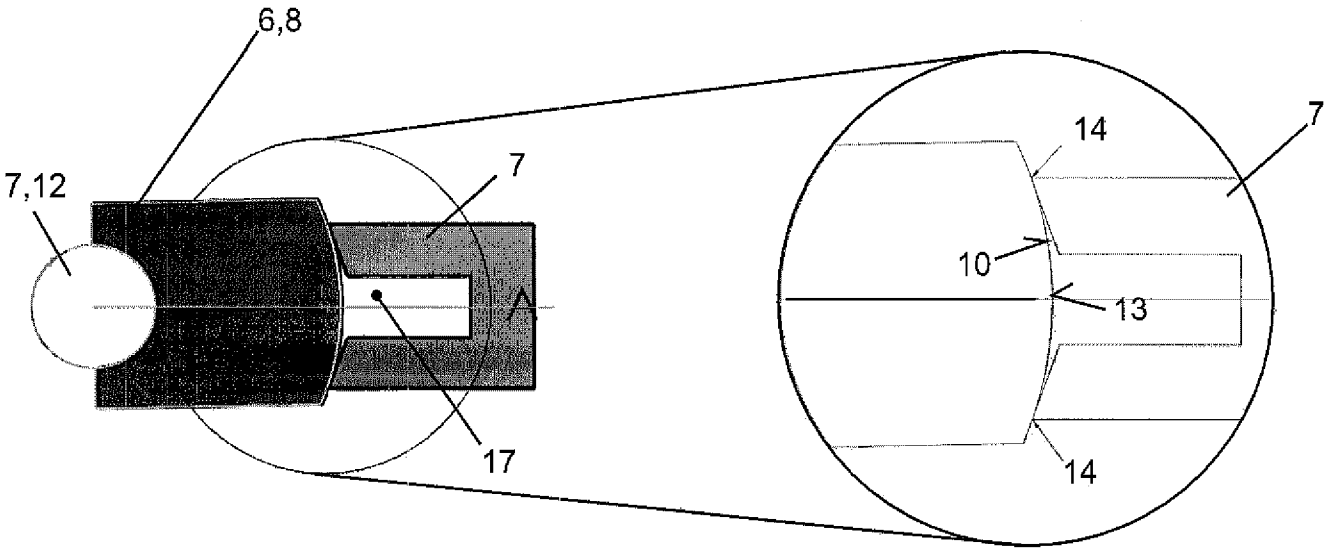
FIG. 8 shows in the same view as the preceding figures a fifth embodiment of the invention

FIG. 8 shows a fifth exemplary embodiment of the invention, wherein subsequently, only the deviations from the embodiment shown in FIG. 5 will be described. Compared to FIG. 5, the clamping means 17 are realised as a holding bracket in the pivot holding device 7, which is opened towards the pivot foot 6. Two arms of the holding bracket provide the clamping surface 10 on their free ends, so that together with the connection surface 13, two contact areas 14 are formed. The contact areas 14 can—as shown—be arranged on the edge side on the clamping surfaces. With modified embodiments, it is also possible that the free ends have a different curve, e.g. a convex curve, in the longitudinal cross-section shown, so that the contact area 14 is at a distance from the edge area of the respective clamping surface 10. The clamping means 17 are attained by a form elasticity, wherein—in a similar manner to that shown in FIGS. 6 and 7—the arms are pressed apart in the radial direction in order to provide the pre-tensioning path.

In conceptional terms, the front area 4 implements a fixed bearing in the axial direction and in the transverse direction, and forms a loose bearing for the pivot angle. By contrast, the rear area 5 is designed as a fixed bearing in the transverse direction and upwards so that the pivot angle is defined, and is realised as a loose bearing in the axial direction. In particular, the sighting telescope 2 is kept tension-free by the mounting system 3.

Figure 9:
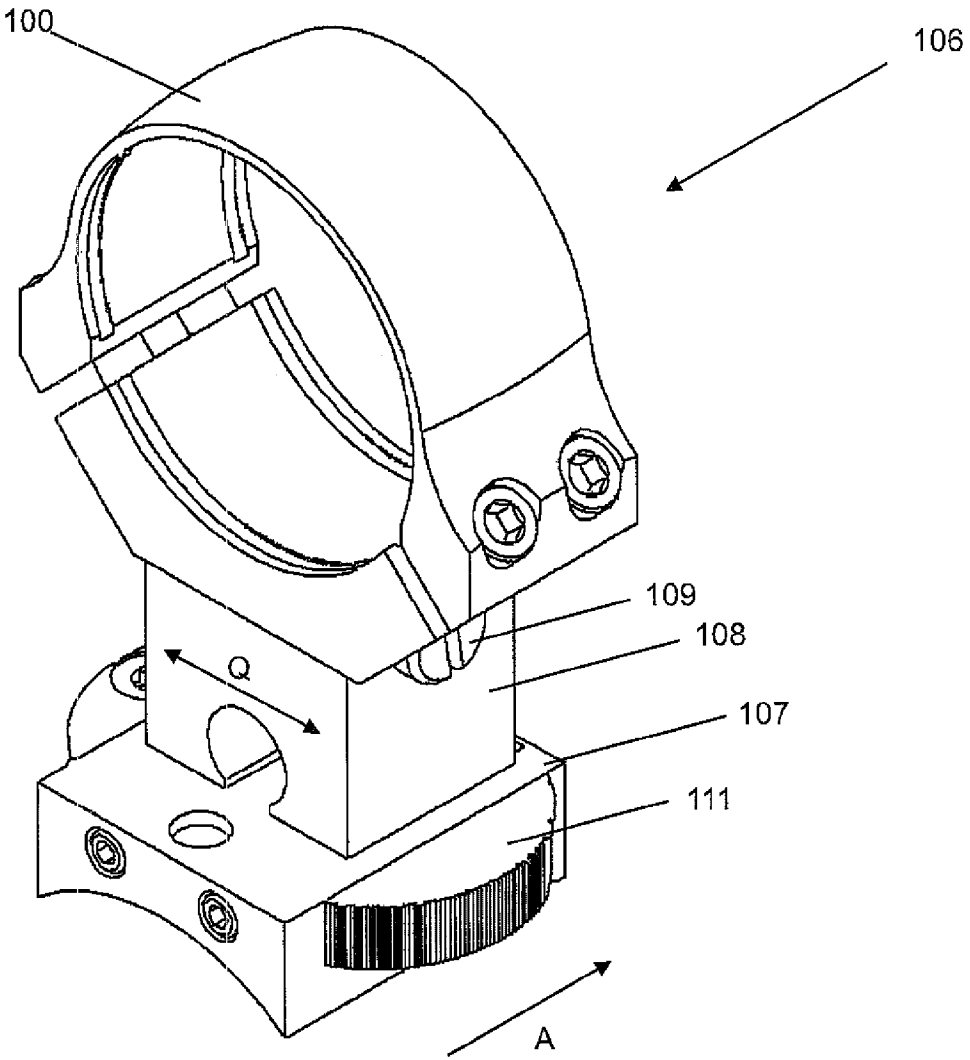
FIG. 9 shows a schematic three-dimensional view of the arresting area of the mounting system shown in FIG. 1

FIG. 9 shows in a schematic three-dimensional view an arresting device 106 which is arranged in a rear attachment area 5 of the mounting system 3, in an arrested state. The arresting device 106 comprises an arresting holding device 107 which is affixed on the firearm 1. In the arresting holding device 107, an arresting foot 108 is inserted and arrested, the precise structure of which will be explained below. The arresting foot 108 is coupled via an adjustment device 109 with a ring holding device 110 which grips and holds the circumference of the sighting telescope 2. When the ring holding device 100 is loosened, the sighting telescope 2 can be turned around its own axis and thus adjusted. The adjusting device 109 serves to alter or adjust the ring holding device 100 relative to the arresting foot 108 in a transverse direction Q. In the arresting holding device 107, a locking slide 111 is arranged which can be moved towards the axial direction A in order to loosen the arrest of the arresting foot 108 in the arresting holding device 107.

Figure 10:
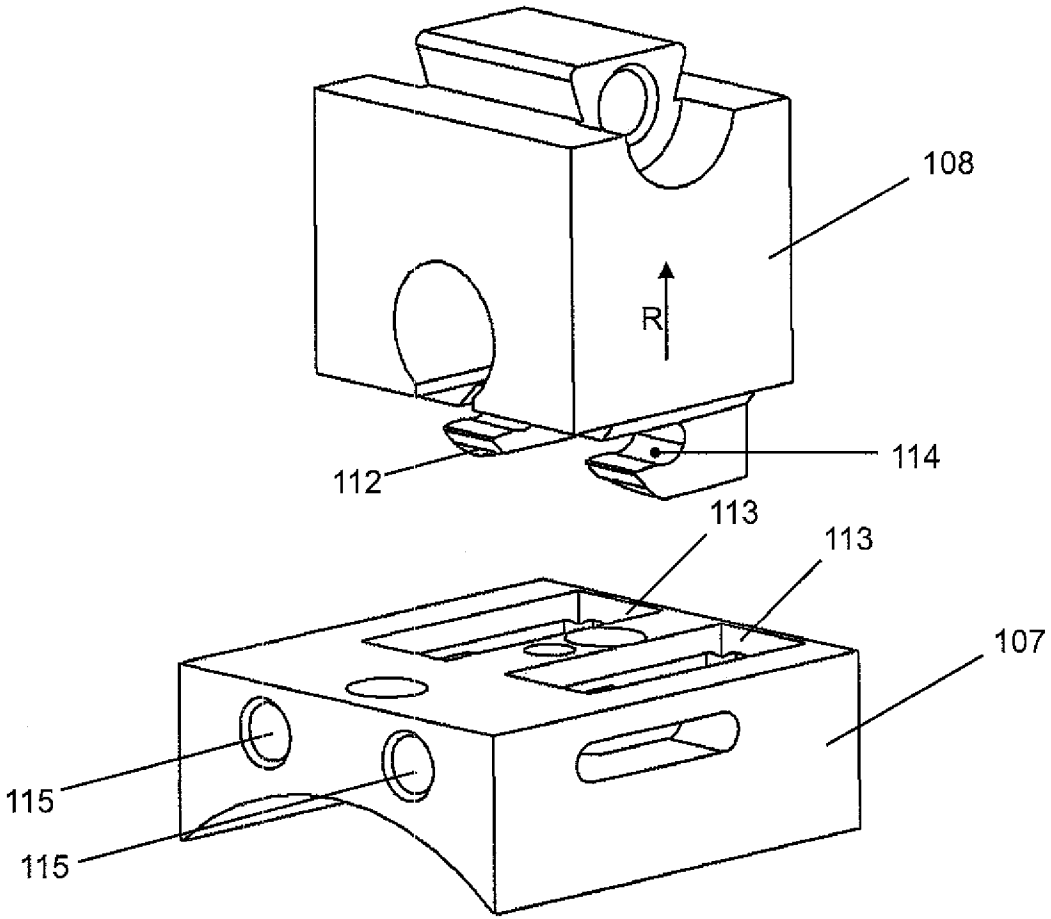
FIG. 10 shows two components of the arresting device shown in FIG. 9 in a similar view, but in an enlarged view

FIG. 10 shows in a schematic three-dimensional view the arresting foot 108 and the arresting holding device 107 in an enlarged view. The arresting foot 108 comprises two hook sections 112 which can be inserted into corresponding slits 113 of the arresting holding device 107. The hook sections 112 are attached as a single piece to the arresting foot 108 and comprise holding areas 114 into which the locking slide 111 grips during locking resulting from a movement in direction A, so that the arresting foot 108 is blocked in a form-fit manner against a movement in the radial direction R to the axial direction A. It should also be noted that the locking slide 111 and the holding areas 114 are designed to be self-impeding, and the locking slide 111 is pre-tensioned via spring elements in the openings 115, not shown, in the direction of the hook sections 112.

When mounting the sighting telescope 2 of the firearm 1, the hooking-in procedure is first conducted, and the arresting foot 108 is subsequently inserted into the slits 113 of the arresting holding device 117 and there locked using the locking slide 111.

Figure 11:
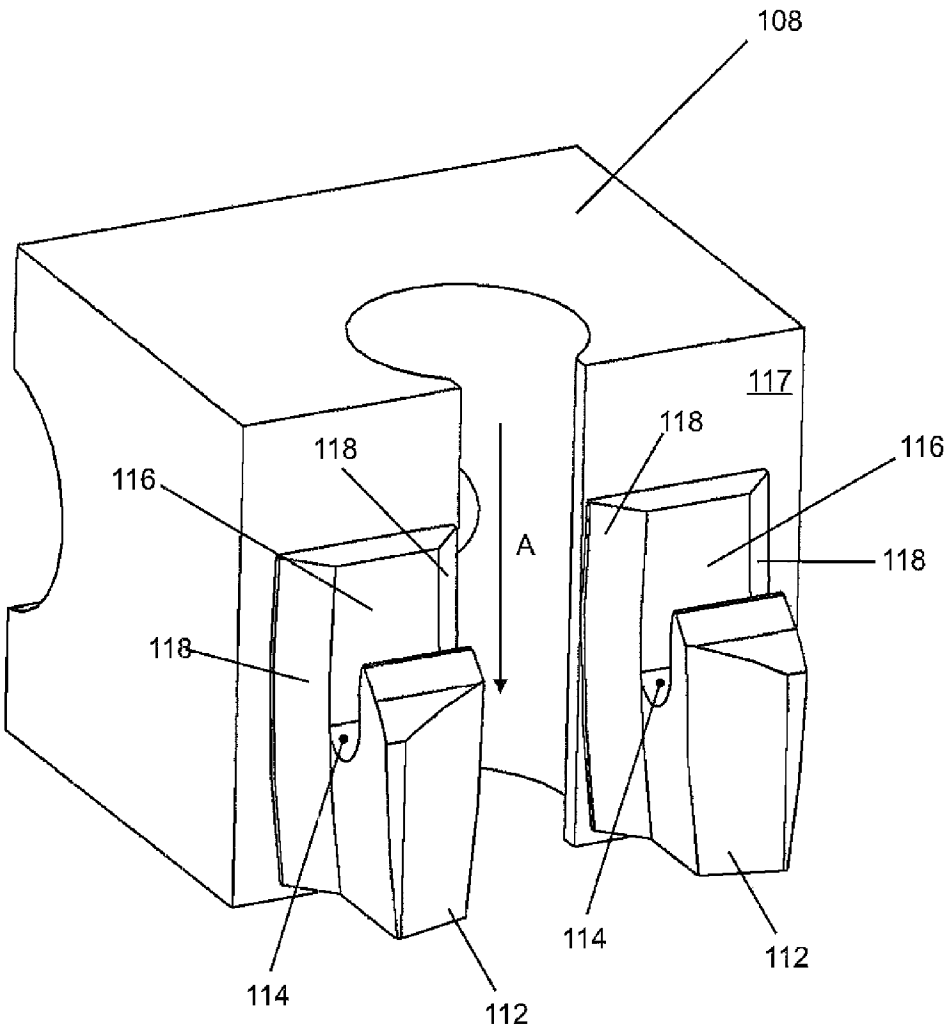
FIG. 11 shows a three-dimensional top view from diagonally below onto a component of the arresting device shown in the preceding figures

FIG. 11 shows a three-dimensional view of the arresting foot 108 from below, in order to better explain the structure of the hook sections 112.

The hook sections 112 comprise a foot area 116 which comprises support surfaces 118 which extend in the radial direction A and which are angled in relation to an underside 117 of the arresting foot 8 by approx. 45°. Two support surfaces 118 are arranged in each foot area 116.

The mounting system 3 is designed in such a manner that a form-fit support of the arresting foot 108 on the arresting holding device 107 is provided only on the support surfaces 118, but not on the underside 117 of the arresting foot 108. Furthermore, the hook sections 112 or the support surfaces 118 or the arresting foot 108 in the arresting holding device 107 are freely movable in the axial direction A—up to the restriction resulting from the locking slide 111. In this embodiment, the arresting foot 108 is held in the transverse direction Q and forms an end stop for the pivot movement according to arrow B in FIG. 1, although it is a loose bearing in the axial direction A.

Figure 13:
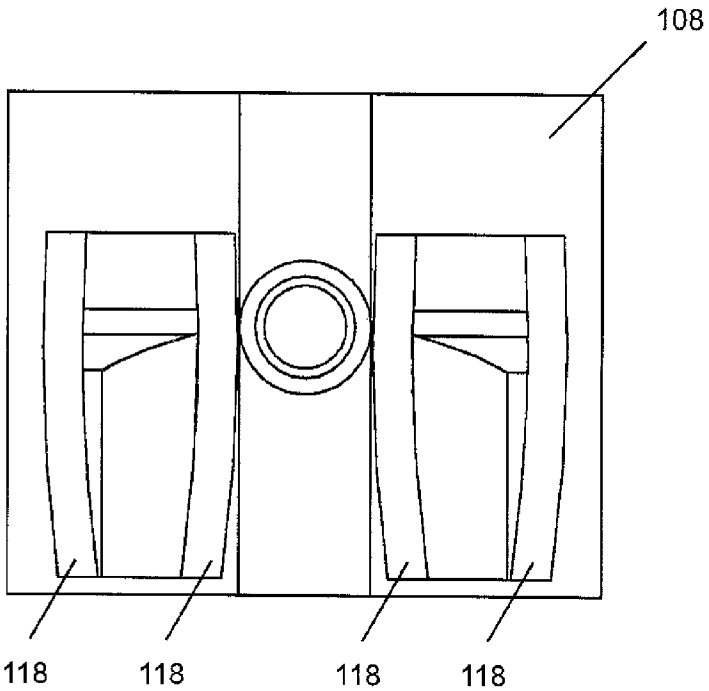
FIG. 13 shows a top view from below onto the arresting foot of the mounting system shown in the preceding figures
Figure 12:
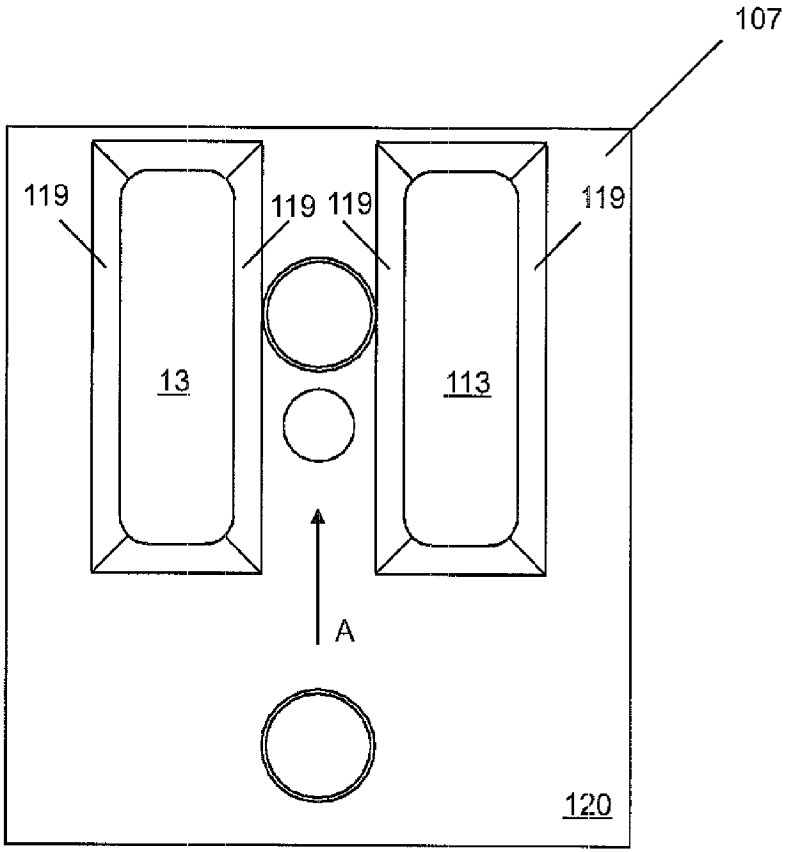
FIG. 12 shows a top view onto the arresting holding device of the mounting system shown in the preceding figures

FIGS. 12 and 13 show a top view of the arresting holding device 107 or a view from below of the arresting foot 108. As can be seen in the drawing in FIG. 13, the support surfaces 118 do not extend in a straight line, but are curved towards each other in pairs. In the edge areas of the slits 113, connection surfaces 119 which correspond to them are arranged which are set at an angle of approx. 45° to the upper side 120 of the arresting holding device 107. In contrast to the support surfaces 118, the connection surfaces 119 run in the axial direction A. The connection surfaces 119 form a V-shaped holding device for each slit 113 in a cross section to the axial direction A.

Figure 14:
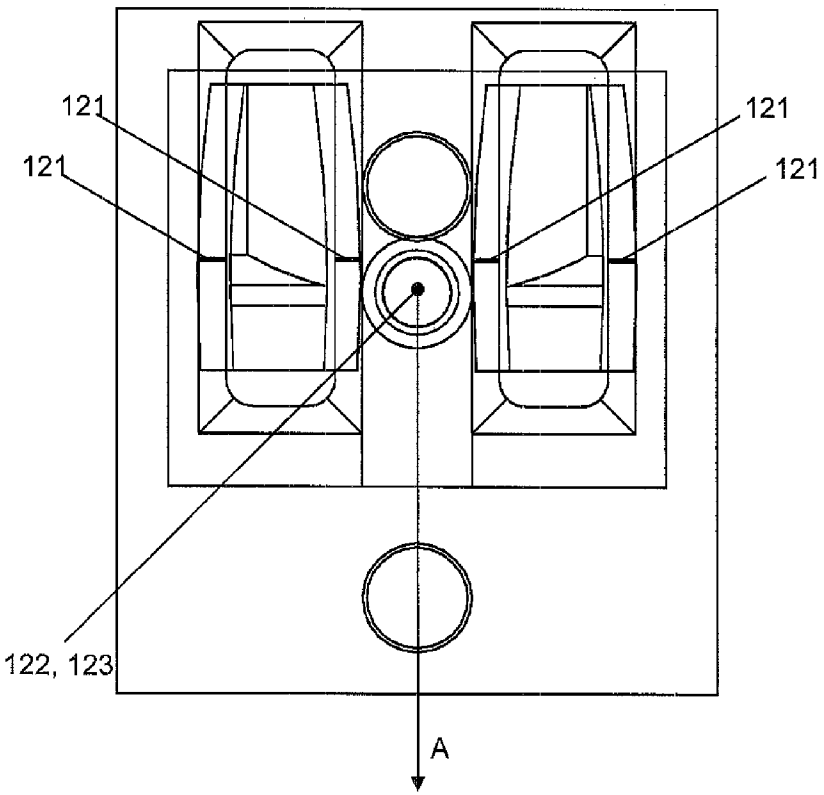
FIG. 14 shows a top view onto the arresting holding device when the arresting foot is attached in an aligned position

With a contact in the ideal alignment of the arresting foot 108 and arresting holding device 107, contact lines 121 are formed which together form a contact area between the support area of the support surfaces 118 and the connection area of the connection surfaces 119. With an ideal alignment in the axial direction A, all contact lines 121 are at the same height. This situation is shown in FIG. 14, in which the arresting foot 108 is shown attached to the arresting holding device 107.

Figure 15:
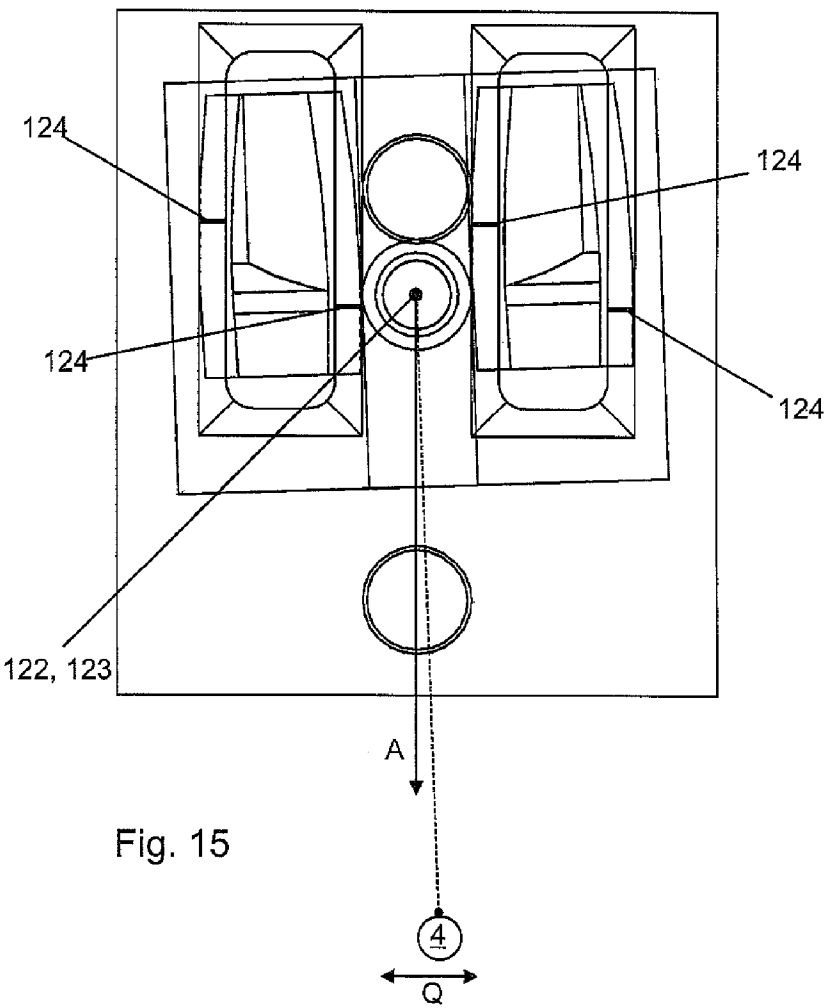
FIG. 15 shows the arrangement in FIG. 14 when the arresting holding device and arresting foot are turned around a yaw angle axis.

When the arresting foot 108 is turned on the arresting holding device 107 around a radially aligned rotation axis, which runs for example through the through bores 122 of the arresting holding device 107 or 123 of the arresting foot 108, the contact lines 121 are displaced and form new contact lines 124 which again ensure a secure support, as is shown in FIG. 15. The resulting angle tolerance of the arresting device 106 in relation to the rotation around the radially aligned rotation axis (yaw angle axis) or the pitch angle axis is achieved by the curved form of the support surfaces 118, wherein with angle variations greater than 0.01°, 0.05°, 0.1° or even 0.4° and less than 3°, the pivot foot 8 also usually lies on the arresting holding device 107 with four, and at least with two line contacts 121 or 124.

In conceptional terms, the arresting device 106 permits a certain offset or angle offset (non-alignment) of the front attachment area 4 in the transverse direction Q, although without having to take into account an impairment in the position definition.

The front attachment area 4 is preferably designed in such a manner that the pivot movement according to arrow B is not fully defined with regard to the pivot angle, i.e. it is in the desired position without an end stop, so that the pivot angle is defined solely by the form-fit connection of the arresting foot 108 on the arresting holding device 107.

Figure 16B:
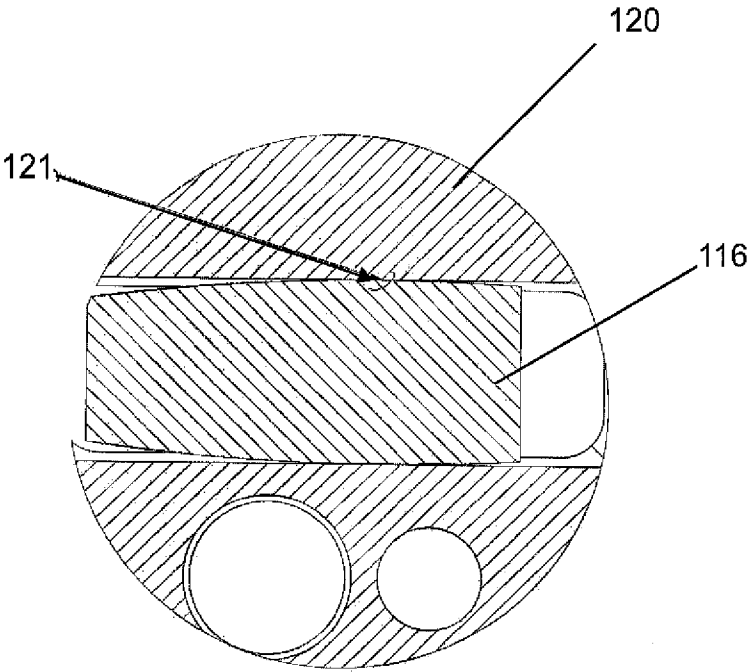
FIGS. 16*a, b* show a schematic side view and a longitudinal section through the arresting device FIGS. 17*a, b* show the arrangement shown in the preceding figures with a rotation of the arresting holding device and arresting foot around a pitch angle axis by 1°
Figure 16A:
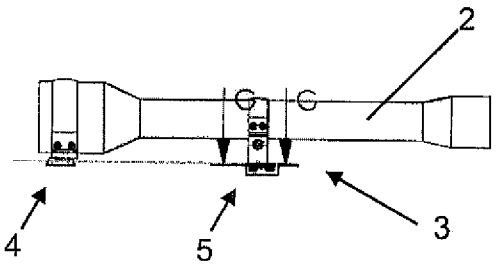
Figure 17B:
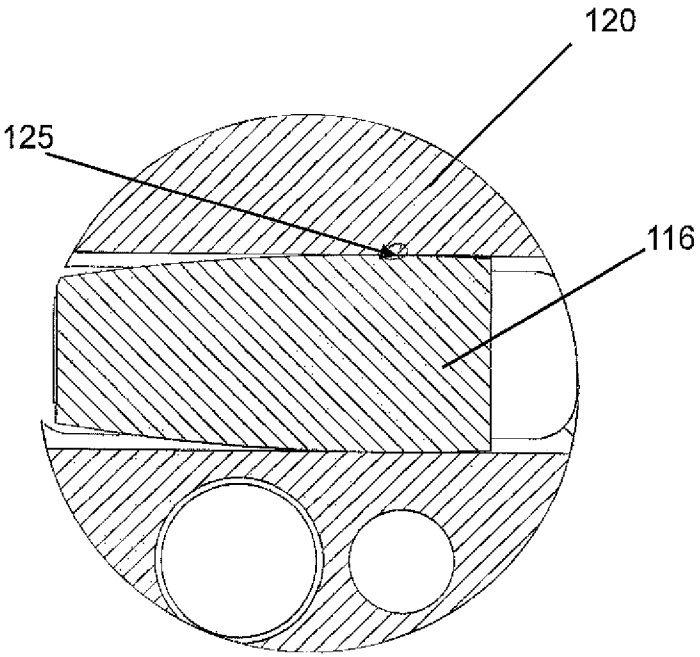
Figure 17A:
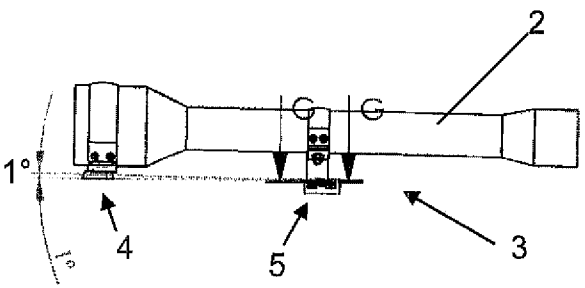
Figure 18B:
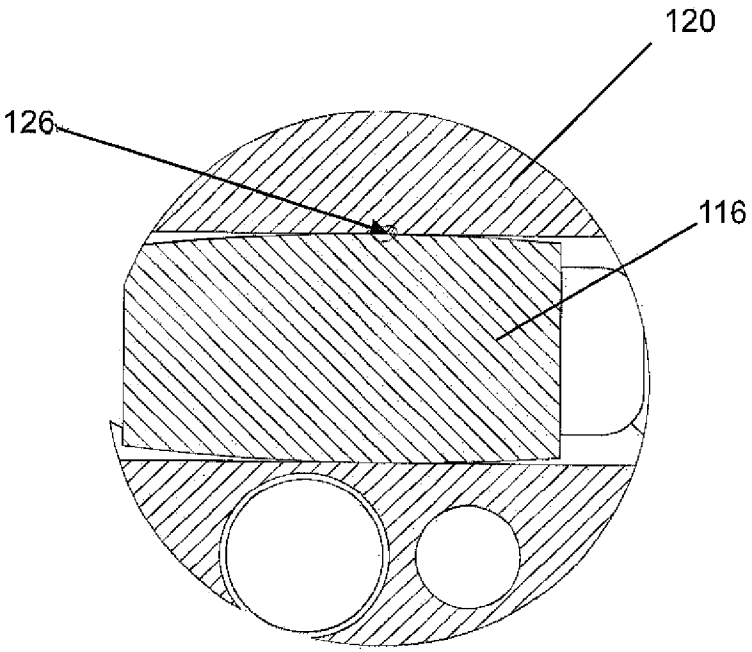
FIGS. 18*a, b* show the arrangement shown in the preceding figures with a rotation of the arresting holding device and arresting foot around a pitch angle axis by −1°
Figure 18A:
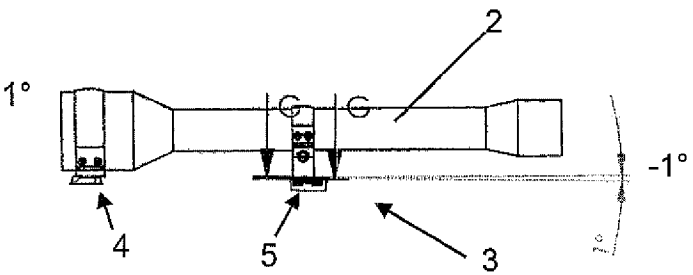

FIGS. 16 to 18 each show a schematic side view onto the arrangement shown in FIG. 1, and a longitudinal cross section parallel to the axial alignment or to the direction of travel through the contact area 121 with different angles around a pitch angle axis, wherein the pitch angle axis runs through the arrest vertically to the direction of travel, i.e. to the direction of travel of the firearm, and vertically to the radial direction. FIGS. 16*a, b* show the arranged with a relative position with regard to the pitch angle to each other of 0°, wherein the contact lines 121 correspond to the contact lines in FIG. 14. In FIGS. 17*a, b* and 18*a, b*, the arresting foot 108 and the arresting holding device 107 are turned towards each other by a pitch angle of +1° or −1°, wherein the contact lines 121 have moved and formed new contact lines 125 and 126.

LIST OF REFERENCE NUMERALS

1 Firearm
2 Sighting telescope
3 Sighting telescope mounting system
4 Front attachment area
5 Rear attachment area
6 Pivot foot
7 Pivot holding device
8 Hook
9 Slits
10 Clamping surface
11 Hook head
12 Bearing position
13 Connection surface
14 Contact area
15 Edge area
16 Gap
17 Clamping means
18 Gap
19 Jaw
20 Hook jaw
21 Stationary area
22 Support area
100 Ring holding device
106 Arresting device
107 Arresting holding device
108 Arresting foot
109 Adjustment device
111 Locking slide
112 Hook sections
113 Slits
114 Holding areas
115 Openings
116 Foot area
117 Underside
118 Support surfaces
119 Connection surfaces
120 Upper side
121 Contact lines
122 Through bores of the arresting holding device
123 Through bores of the arresting foot
124 New contact lines
125 New contact lines
126 New contact lines

The invention claimed is:

1. A mounting system for mounting a sighting telescope onto a firearm, wherein the firearm and/or the sighting telescope are aligned in the mounted position in an axial direction, the mounting system comprising:

a pivot foot attachable to one of the sighting telescope and the firearm;

a pivot holding device affixable to the other of the sighting telescope and the firearm, the pivot foot and the pivot holding device together forming a pivot joint, which during mounting enables the sighting telescope to pivot by a pivot angle around a pivot range on a plane which is formed by an axial extension of the sighting telescope and the axial direction of the firearm in the mounted position;

a connection surface arranged on the pivot holding device;

a clamping surface arranged on the pivot foot, which, when mounted, forms a contact area with the connection surface, so that the pivot foot is affixed to the pivot holding device in the axial direction;

clamping means for elastically damping the pivot foot in the pivot holding device in a pre-tensioned state at least in the axial direction so that the connection surface is pretensioned against the clamping surface in the axial direction at the contact area,the clamping means being designed so that at least one of the connection surface and the clamping surface is compliantly arranged and/or designed, and the clamping means is arranged in at least one of the pivot foot and the pivot holding device; and an arresting device comprising an arresting foot attachable to one of the sighting telescope and the firearm and an arresting holding device attachable to the other of the sighting telescope and the firearm, the arresting device being a fixed bearing in the transverse direction and a loose bearing in the axial direction.

2. The sighting telescope mounting system according to claim 1, wherein, in the mounted position, the connection surface and/or the clamping surface is deflected in the axial direction by a pre-tensioning path of at least 5 μm.

3. The sighting telescope mounting system according to claim 2, wherein, in the mounted position, the connection surface and/or the damping surface is deflected in the axial direction by a pre-tensioning path of at least 10 μm.

4. The sighting telescope mounting system according to claim 3, wherein, in the mounted position, the connection surface and/or the clamping surface is deflected in the axial direction by a pre-tensioning path of at least 60 μm.

5. The sighting telescope mounting system according to claim 1, wherein the clamping means includes an overall pre-tensioning path in the axial direction of at least 20 μm.

6. The sighting telescope mounting system according to claim 5, wherein the clamping means includes an overall pre-tensioning path in the axial direction of at least 30 μm.

7. The sighting telescope mounting system according to claim 6, wherein the clamping means includes an overall pre-tensioning path in the axial direction of at least 80 μm.

8. The sighting telescope mounting system according to claim 2, wherein the damping means are formed by an interaction between the pivot foot and the pivot holding device.

9. The sighting telescope mounting system according to claim 1, wherein the pivot foot comprises a holding bracket which grips a section of the pivot holding device, or in that the pivot holding device comprises a holding bracket which grips a section of the pivot foot.

10. A sighting telescope mounting system according to claim 9, wherein the gripped section is a pin.

11. A sighting telescope mounting system according to claim 9, wherein the gripped section is a section which is arranged as a single piece in the pivot holding device.

12. A sighting telescope mounting system according to claim 9, wherein the holding bracket forms a part of the clamping means.

13. A sighting telescope mounting system according to claim 8, wherein the pivot foot is installed in a deflected state in the pivot holding device along the path in the axial direction.

14. A sighting telescope mounting system according to claim 1, wherein, in the mounted position, the contact area is arranged in radial alignment and/or towards the sighting telescope at a distance to an edge of the connection surface.

15. The sighting telescope mounting system according to claim 14, wherein, in the mounted position, a radially outwardly opening gap is formed between the connection surface and the damping surface, starting from the contact area.

16. The sighting telescope mounting system according to claim 1, wherein the pivot foot is pre-tensioned in a direction of the arresting device.

17. The sighting telescope mounting system according to claim 1, wherein the arresting foot comprises at least one support area, and the arresting holding device comprises at least one connection area, wherein, due to the support area and the connection area in an arresting contact area, a form-fit connection of the arresting foot is implemented on the arresting holding device in a first radial direction, wherein the arresting foot and the arresting holding device form an arrest, which detachably affixes the arresting foot in the other radial direction in an arresting position of the arrest, and wherein the support area and the connection area are designed so that the arresting foot can be arrested in the arresting holding device in different angle positions around at least one pivot axis relative to the arresting holding device.

18. The sighting telescope mounting system according to claim 17, wherein the arresting foot can be arrested in different yaw angle positions around a radially aligned pivot axis, which runs through the arresting holding device and/or the arresting foot, and/or the arresting foot can be arrested in different roll angle positions around an axially aligned pivot axis, and/or the arresting foot can be arrested in different pitch angle positions around a pivot axis, which runs through the arresting holding device and/or the arresting foot.

19. The sighting telescope mounting system according to claim 17, wherein the support area and the connection area are designed so that the arresting foot can be moved in the axial direction and is held in a form-fit manner in a transverse direction, which is aligned vertically to the axial direction and to the radial direction,

20. The sighting telescope mounting system according to claim 1, wherein the pivot foot comprises at least one portion that is insertable into the pivot holding device such that the at least one portion and the pivot holding device together form the pivoting joint.

21. The sighting telescope mounting system according to claim 1, wherein the at least one portion of the pivot foot comprises at least one hook that can be hooked into the pivot holding device.

* * * * *